United States Patent [19]

Aoki et al.

[11] Patent Number: 4,980,601

[45] Date of Patent: Dec. 25, 1990

[54] IGNITER PLUG PARTICULARLY FOR USE IN VERY LOW TEMPERATURE LIQUID FUEL

[75] Inventors: Noboru Aoki; Takahiro Suzuki, both of Nagoya, Japan

[73] Assignee: NGK Spark Plug Co., Ltd., Nagoya, Japan

[21] Appl. No.: 342,735

[22] Filed: Apr. 24, 1989

[30] Foreign Application Priority Data

Jul. 6, 1988 [JP] Japan ..... 63-89843[U]

[51] Int. Cl.[5] ..... H01T 13/20

[52] U.S. Cl. ..... 313/143; 313/141

[58] Field of Search ..... 313/141, 143, 144

[56] References Cited

U.S. PATENT DOCUMENTS 2,183,696 12/1939 Rohde ..... 313/144 X 2,406,172 8/1946 Smithells ..... 313/141

4,695,758 9/1987 Nishida et al. ..... 313/138 X

FOREIGN PATENT DOCUMENTS 717555 10/1954 United Kingdom ..... 313/141.1

*Primary Examiner*—Sandra L. O'Shea

*Attorney, Agent, or Firm*—Cooper & Dunham

[57] ABSTRACT

An igniter plug is provided with a metallic shell, an insulator located within the metallic shell and a center electrode within the inner bore of the insulator. The front end of the electrode extends outside beyond the front end of the insulator. The insulator is made from sintered ceramic material which includes silicon nitride in an amount in the range 85–99% by weight. The front end of the insulator is axially retracted interiorally from the front end of the metallic shell from about 1.5 to about 2.5 mm.

5 Claims, 2 Drawing Sheets

IGNITER PLUG PARTICULARLY FOR USE IN VERY LOW TEMPERATURE LIQUID FUEL

BACKGROUND OF THE INVENTION

1. Field of the Invention

This invention relates to an igniter plug which is exposed to the presence of extremely great temperature difference, and particular concerned to an igniter plug for use in a rocket propelled engine in which liquefied hydrogen and liquefied oxygen are employed as components of liquid fuel.

2. Description of the Prior Art

In an igniter plug for use in a rocket propelled engine in which liquid fuel mixture is ignited at combustion chamber to generate a propulsion, the igniter includes a metallic shell into which a tubular insulator is placed through which a center electrode passes.

In this instance, a front end of the insulator somewhat extends outside beyond that of the metallic shell.

Meanwhile, the plug is exposed to very low temperature such as approximately 200 degrees Celsius below the freezing point when the engine just began to start.

Once the engine has started, the plug is exposed to extremely high temperature such as some thousands degrees Celsius. In addition to this, aqueous component emerged at the time of the fuel combustion, adheres to an extended front end, and retained there.

The aqueous component is frozen by the liquefied fuel at the time of restarting the engine. This freezing hinders temperature of the insulator from uniformly rising.

The huge temperature difference causes thermal shock to run through the insulator, at the same time, the freezing causes to induce thermal stress at the insulator to eventually result in cracks. Because the prior insulator has been made of an alumina ceramic material having a poor thermal conductivity at high temperature, and a relatively great thermal expansional coefficient of $8.5\text{-}10.0\times10^{-6}/k$.

Therefore, it is an object of this invention to provide the igniter plug which is capable of avoiding thermal shock from being induced, and at the same time, substantially preventing aqueous component from adhering, and being retained to an insulator thereby making free from freeze of the aqueous component, relieving of thermal stress to occur.

According to the invention there is provided the igniter plug comprising; the cylindrical metallic shell; the tubular insulator concentrically located within the metallic shell; the center electrode placed to pass through an inner bore of the insulator, the front end of the electrode extending outside beyond the front end surface of the insulator to be exposed to a passage through which an liquid fuel mixture passes; the insulator being made from a sintered ceramics which includes silicone nitride component ranging from 85% to 99% inclusive by weight, while the front end surface of the insulator being retracted into that of the metallic shell, retracted degree of the insulator being within the range from 1.5 mm to 2.5 mm.

The insulator is made of sintered ceramics including silicon nitrate component ranging from 85% to 99% by weight. The sintered ceramics has a small thermal coefficient of $3.0\times10^{-6}-3.5\times10^{-6}/K$ with a relatively good thermal conductivity, thus protecting thermal shock from being induced on the insulator to prevent cracks even though the igniter is exposed to an atmosphere of huge temperature difference.

The reason the weight percent of the silicon nitrate component is determined as above, is that the silicon nitride under the level of 85%, becomes short of bending strength, while the one exceeding to the level of 99%, becomes poor in sintering and rigidity.

On the other hand, the front end of the insulator is retracted inner side from that of the metallic shell by the degree from 1.5 mm to 2.5 mm, thus avoiding aqueous component from adhering, and being retained to the front end of the insulator.

This holds the insulator free from freezing by preventing thermal stress from occurring due to uniform temperature rise, avoiding cracks from occurring on the insulator.

These and other objects and advantages of the invention will be apparent upon reference to the following specification, attendant claims, and drawings.

DETAILED DESCRIPTION OF THE INVENTION

Figure 1:
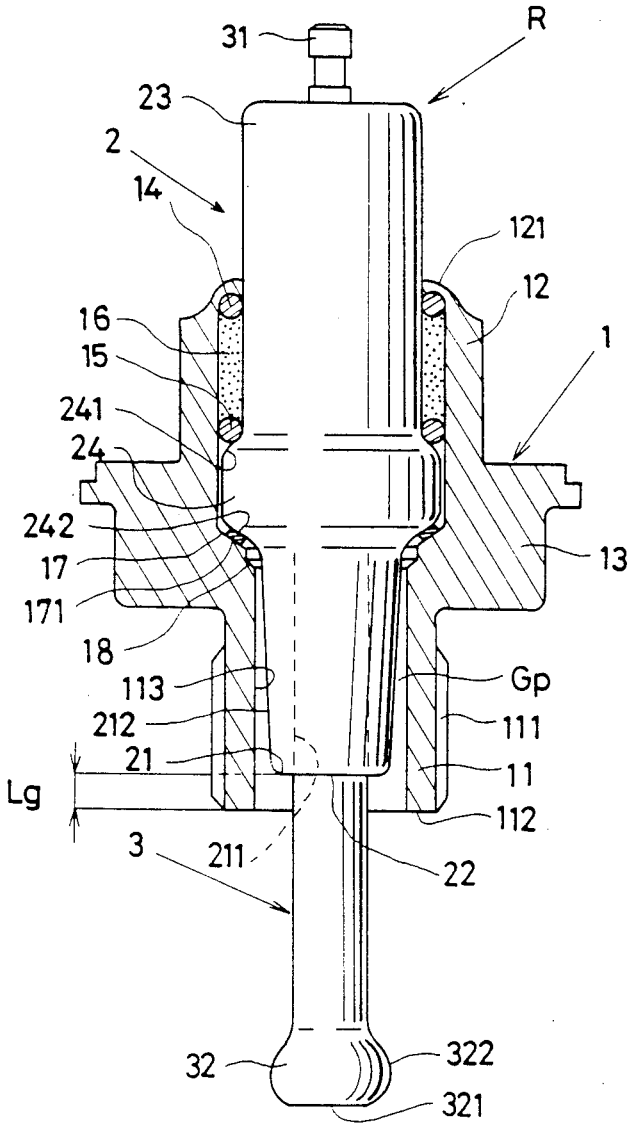
FIG. 1 is an elevational view of an igniter plug according to an embodiment of this invention, but partly sectioned.
Figure 2:
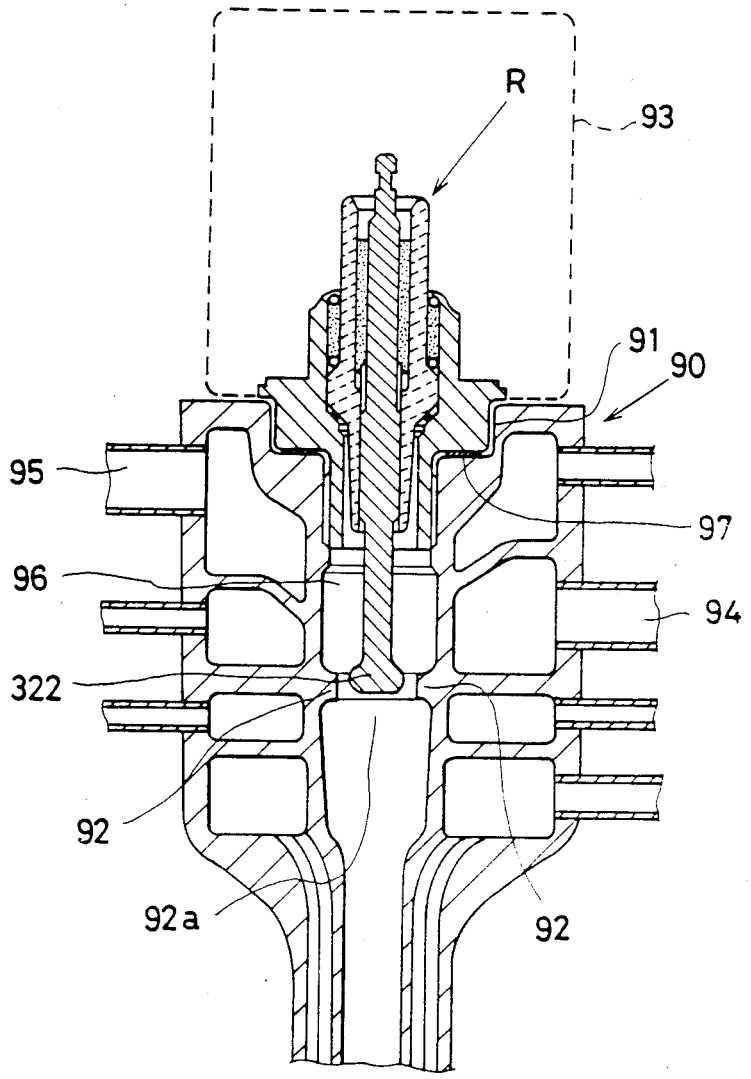
FIG. 2 is a longitudinal cross sectional view of above igniter plug incorporated into a pre-burner spark device of a rocket propelled engine.

Referring to FIGS. 1 and 2 of the drawings, an igniter plug designated at (R), is for use in very low temperature liquid fuel. The igniter plug (R) comprising a cylindrical metallic shell 1, a tubular insulator 2 and a center electrode 3, and is to be mounted on a pre-burner spark device 90 incorporated into a rocket propelled engine as described hereinafter.

The metallic shell 1 is made of Inconel (registered Trade Mark), and has a male thread 111 at an outer surface of the front portion for the sake of convenience when mounting on the pre-burner spark device 90. At a middle portion of the metallic shell 1, is a diameter-increased flange 13 provided which is to be interfit through a gasket 97 into a recess 91 formed at the pre-burner spark device 90. The shell 1 has a rear portion 12 somewhat enlarged in diametrical direction which is terminated at its open rear end 121. The rear open end 121 is turned inward to act as a caulking against the insulator 2 which is concentrically located within the shell 1. An inner wall portion of the shell 1, is contoured to consecutively provide two annular shoulders 17 and 18 of different tapered degree at a portion corresponding to the flange 13. A diameter-increased portion 24 is provided at the middle of the insulator 2. At the boundary areas in which upper and lower surface of the portion 24 each meet an outer surface of the insulator 2, are tapered surfaces 241 and 242 provided. The diameter-increased portion 24 of the insulator 2 is received by the shoulder 17 through the tapered surface 241 and a packing 171.

At the tapered surface 241 and the caulked end 121 of the shell 1, circular packings 14 and 15 surround the insulator 2 respectively. An annular space between inner surface of the shell 1 and outer surface of the insulator 2, is filled with a talc 16 extending from the packing 14 to the packing 15.

The insulator 2 is made from sintered ceramics including silicon nitride component within the range from 85% to 99% by weight. A front end surface 22 of the insulator 2 has a beveled portion 21 at its periphery, and is axially retracted inside from an end surface 112 of the shell 1 by the dimension of 2.0 mm as designated at (Lg), but exaggerated in the drawing for the purpose of elucidation.

The frontal part of the insulator 2 is located to have a slight clearance (Gp) with an inner wall 113 of a front part 11 of the metallic shell 1, and at the same time, an outer surface 212 of the frontal part is tapered, so that the clearance (Gp) progressively increases in the radial direction as approaching to the front end surface 22.

The center electrode 3 is made of platinum and rhodium-based alloy, and located to pass through an axial bore 211 of the insulator 2. A rear end of the electrode 3 extends beyond an end portion 23 of the insulator 2 to have a terminal 31 to which a high voltage power source 93 is connected by way of tension cord (not shown). A front end 32 of the electrode 3 extends outside from both the front end surfaces 22 and 112 of the insulator 2 and the shell 1 to form a bulge portion having a circumference 322 and a front surface end 321.

The front end 32 is located, so that the circumference 322 is surrounded by an annular wall 92 which is provided with a passage 92*a* of a pre-burner spark device 96 when the igniter plug (R) mounted on the device 96 in FIG. 2. The annular wall 92 is located to surround the bulge portion of the center electrode 3 to act as a ground electrode so as to cause a spark discharge from the center electrode 3 to the annular wall 92. The pre-burner spark device 96 includes a liquefied hydrogen port 94 and liquefied oxygen port 95 and the liquid fuel mixture of the liquefied hydrogen and oxygen is to be fed into the device 96. During process in which the mixture fuel passes the passage 92*a*, the spark occurs between the circumference 322 and the annular wall 92 to ignite it.

According to the invention, the following effects are obtained.

The insulator 2 is made of sintered ceramics including silicon nitride component ranging from 85% to 99% by weight. The sintered ceramics has small thermal coefficient of $3.0\times10^{-6}-3.5\times10^{-6}$/K with relatively good thermal conductivity, thus substantially protecting thermal shock from being induced on the insulator 2 to prevent cracks even through the igniter plug (R) is exposed to the huge temperature difference between the time when the engine just began to start and the time the engine had started in operation.

On the other hand, the front end surface 22 of the insulator 2 is retracted inner side from that of the metallic shell 1 by the degree ranging from 1.5 mm to 2.5 mm.

Thus enables to generally block avoiding aqueous component from adhering to the outer surface 212 of the insulator 2.

In particular, such is the structure of the igniter plug that aqueous component is generally avoided from being retained at the clearance (Gp) under the influence of surface tension in opposition to that in which the insulator extends beyond the front end of the metallic shell.

This holds the insulator 2 free from freezing by preventing thermal stress from occurring due to uniform temperature rise, avoiding cracks from occurring on the insulator 2 to contribute to a long servicing life.

It is appreciated that auxiliary agents such as magnesia (MgO), Alumina ($Al_2O_3$) and yttrium oxide ($Y_2O_3$) may be added to the sintered ceramics.

Further, it is noted that the igniter plug according to the invention may be applied to a rocket engine in which liquefied hydrogen-kerosene based fuel, or sulfur-hydrazine based fuel is employed which results in no aqueous component at the time of combustion.

In addition, the front end surface 22 of the insulator 2 may be exactly retracted into the metallic shell by the length of 1.5 mm or 2.5 mm as modified forms of this invention.

While a preferred embodiment of the invention has been disclosed using specific terms, such description is for illustrative purpose only, and it is understood that changes and variations may be made without departing the split or scope of the following claims.

What is claimed is:

1. An igniter plug particularly for use with very low temperature liquid fuel comprising:

a cylindrical metallic shell;

a tubular insulator concentrically located within said metallic shell with a slight annular clearance formed between the front half portion of the insulator and that of the metallic shell;

a center electrode placed to pass through an inner bore of said insulator, the front end of said electrode extending outside beyond the front end of said insulator to be exposed to the liquid fuel mixture, the front end of said electrode being diametrically bulged to form the discharge end;

said insulator being made from sintered ceramics which includes silicone nitride in the amount from 85% to 99% inclusive by weight, the front end of said insulator being axially retracted interiorally of said metallic shell, the amount of axial retraction of said insulator being in the range 1.5 mm to 2.5 mm.

2. An igniter plug as recited in claim 1, in which the annular space defined between an inner surface of said metallic shell and an outer surface of the rear portion of said insulator is filled with talc.

3. An igniter plug as recited in claim 1, in which said sintered ceramics includes magnesia, alumina and yttrium oxide as auxiliary agents.

4. An igniter plug as recited in claim 1, in which said center electrode is made of an alloy of platinum and rhodium-based metals.

5. An igniter plug as recited in claim 1, wherein the front half portion of the insulator is tapered so that the slight annular clearance progressively increases in the radial direction toward the rear surface of the insulator.

* * * * *